US008794940B2

(12) United States Patent
Ancel et al.

(10) Patent No.: US 8,794,940 B2
(45) Date of Patent: Aug. 5, 2014

(54) SCROLL-TYPE REFRIGERATOR COMPRESSOR

(75) Inventors: Christophe Ancel, Villerfranche sur Saone (FR); Pierre Ginies, Sathonay Village (FR); Pierre Emilien Clement, Flavigny sur Moselle (FR)

(73) Assignee: Danfoss Commercial Compressors, Trevoux (FR)

( * ) Notice: Subject to any disclaimer, the term of this patent is extended or adjusted under 35 U.S.C. 154(b) by 305 days.

(21) Appl. No.: 13/128,775

(22) PCT Filed: Dec. 14, 2009

(86) PCT No.: PCT/FR2009/052515

§ 371 (c)(1), (2), (4) Date: Sep. 9, 2011

(87) PCT Pub. No.: WO2010/070227

PCT Pub. Date: Jun. 24, 2010

(65) Prior Publication Data

US 2011/0318212 A1 Dec. 29, 2011

(30) Foreign Application Priority Data

Dec. 19, 2008 (FR) ..... 08 58815

(51) Int. Cl.

| | |
|---|---|
| ***F01C 1/02*** | (2006.01) |
| ***F03C 2/00*** | (2006.01) |
| ***F03C 4/00*** | (2006.01) |
| ***F04C 2/00*** | (2006.01) |

(52) U.S. Cl.

USPC ..... 418/55.1; 418/15; 418/55.5; 418/57; 418/270

(58) Field of Classification Search

CPC ..... F04C 28/24; F04C 28/26; F04C 18/0215; F04C 27/005; F01C 1/0215; F04B 49/03; F04B 49/035; F04B 49/24

USPC ..... 418/55.1–55.6, 180, 270, 15, 97; 417/307–308, 310, 410.1

See application file for complete search history.

(56) References Cited

U.S. PATENT DOCUMENTS 4,475,360 A 10/1984 Suefuji et al.
4,714,415 A * 12/1987 Mizuno et al. ..... 418/55.1

(Continued)

FOREIGN PATENT DOCUMENTS

EP 0 385 560 A2 9/1990
EP 0 987 440 A1 3/2000

(Continued)

OTHER PUBLICATIONS

International Search Report mailed Jul. 29, 2010 issued in International Patent Application No. PCT/FR2009/052515 (with translation).

*Primary Examiner* — Theresa Trieu
(74) *Attorney, Agent, or Firm* — Oliff PLC

(57) ABSTRACT

This compressor comprises first and second volutes describing an orbital relative movement and each comprising a plate from which a spiral extends, the two spirals being engaged one inside the other and defining pairs of compression chambers of variable volume. The compressor has a housing formed in that surface of the plate of the first volute which is turned towards the spirals, which housing opens into one of the compression chambers, refrigerant delivery means leading into the housing, and a nonreturn device being mounted in the housing, the nonreturn device preventing communication between the delivery means and the compression chamber into which housing opens in a first or closed position, and allowing communication between the delivery means and said compression chamber in a second or open position.

15 Claims, 7 Drawing Sheets

(56) References Cited

U.S. PATENT DOCUMENTS

| | | | | |
|---|---|---|---|---|
| 5,722,257 | A * | 3/1998 | Ishii et al. | 418/55.5 |
| 7,100,386 | B2 | 9/2006 | Lifson | |
| 2005/0019178 | A1* | 1/2005 | Shin et al. | 417/310 |
| 2008/0107555 | A1* | 5/2008 | Lifson | 418/55.1 |
| 2009/0074593 | A1* | 3/2009 | Joo et al. | 418/55.5 |

FOREIGN PATENT DOCUMENTS

| | | | | |
|---|---|---|---|---|
| EP | 1 921 320 | A2 | 5/2008 | |
| JP | A-62-70681 | | 4/1987 | |
| JP | 08144971 | A * | 6/1996 | F04C 18/02 |
| WO | WO 2007/114531 | A1 | 10/2007 | |

* cited by examiner

SCROLL-TYPE REFRIGERATOR COMPRESSOR

BACKGROUND

The present invention relates to a scroll-type refrigerator compressor.

In a known way, a scroll type refrigerator compressor comprises first and second volutes describing an orbital relative movement, each volute including a plate from which a spiral extends, the two spirals being engaged one inside the other and delimiting pairs of compression chambers of variable volume, the compression chambers having a volume which gradually decreases from the outside, where admission of refrigerant gas is accomplished inwards.

Thus, during the orbital relative movement of the first and second volutes, the refrigerant gas is compressed because of the reduction in the volume of the compression chambers and conveyed to the centre of the first and second volutes. The compressed refrigerant gas in the central portion flows out towards a recovery chamber via a discharge orifice made in one of the first and second volutes.

In order to improve the performances of such a compressor according to the seasons, and more particularly according to the demand for cold it is known how to make compressors with variable capacity and with variable compression level.

Document U.S. Pat. No. 7,100,386 describes a scroll-type refrigerator compressor with variable capacity comprising an orifice for letting through a refrigerant gas, made in the plate of one of the volutes and opening into one of the compression chambers.

This compressor further comprises a bypass circuit communicating with the passage orifice and a bypass valve arranged for diverting a portion of the refrigerant gas contained in the compression chambers towards the low pressure side of the compressor. With these arrangements it is possible to reduce the capacity or cylinder volume of the compressor.

This compressor also comprises a circuit for injecting refrigerant gas, communicating with the passage orifice and an injection valve arranged for injecting refrigerant gas into the compression chambers towards the low pressure side of the compressor. With these arrangements it is possible to increase the capacity of the compressor.

Thus, by suitably controlling the opening and closing of the injection and bypass valves, it is possible to adapt the capacity of the compressor according to the demand for cold.

According to a first embodiment described in document U.S. Pat. No. 7,100,386, the injection and bypass valves are both arranged outside the compressor. According to a second embodiment described in U.S. Pat. No. 7,100,386, the injection valve is arranged outside the compressor and the bypass valve is arranged in the suction stage.

Consequently, the distances between the passage orifice and the injection and bypass valves are significant, which generates a significant dead space.

Thus, when one of the valves or when both valves are in the closed position, a significant amount of refrigerant gas may flow through the passage orifice of the compression chambers towards the dead spaces of the injection and/or bypass circuits.

Now, since the pressure in each compression chamber varies from a minimum value to a maximum value during the orbital relative movement of the first and second volutes, the result of this is the occurrence of pressure pulsations in the injection and/or bypass circuits. These pressure pulsations cause overpressures and depressions in the compression chambers which may be detrimental to the performances of the compressor.

In order to overcome these drawbacks, positioning an anti-return device in proximity to the orifice for letting through refrigerant gas, made in the plate of the fixed volute, is known from document U.S. Pat. No. 4,475,360.

For this purpose, the surface of the plate of the fixed volute turned towards the side opposite to the spirals comprises a housing in which an anti-return device is mounted. The anti-return device is mobile between an open position allowing refrigerant gas to be injected into the compression chamber into which the passage orifice opens out, and a closed position preventing backflow of refrigerant gas from said compression chamber towards the refrigerant gas injection means.

With these arrangements it is possible to avoid the generation of significant dead space and therefore the occurrence of pressure fluctuations which may reduce the performances of the compressor.

However, installing an anti-return device on the upper surface of the fixed volute of a compressor may prove to be difficult, or even impossible notably when the access to the upper portion of the fixed volute is hindered by the existence of a bell covering the fixed volute or by the presence of seal elements at the discharge orifice.

SUMMARY

The present invention aims at finding a remedy to these drawbacks.

The technical problem at the basis of the invention therefore consists of providing a scroll-type refrigerator compressor which is of a simple and economical structure, while allowing simple and easy mounting of an anti-return device on one of the volutes of the compressor.

For this purpose, the invention relates to a scroll-type refrigerator compressor, comprising first and second volutes describing an orbital relative movement, each volute including a plate from which a spiral extends, both spirals being engaged inside each other and delimiting at least two compression chambers of variable volume, characterized in that the compressor includes:

- at least one housing formed in the surface of the plate of one of the first and second volutes turned towards the spirals, the housing opening out into one of the compression chambers,
- means for discharging and/or injecting refrigerant fluid, opening out into the housing,
- an anti-return device mounted in the housing, the anti-return device being arranged so as to prevent communication between means for discharging and/or injecting refrigerant fluid and the compression chamber into which the housing opens out in a first closed position, and being arranged so as to allow communication between the means for discharging and/or injecting refrigerant fluid and the compression chamber into which the housing opens out in a second open position.

The machining of a housing arranged for receiving an anti-return device in the surface of the plate of one of the volutes turned towards the spirals may easily be achieved, and is by no means hindered by the presence of a bell covering the fixed volute or of seal elements at the discharge orifice.

Thus, the compressor according to the invention allows simple and easy mounting of an anti-return device on one of the volutes of the compressor.

According to an embodiment of the invention, the anti-return device comprises a member forming a valve seat and an anti-return valve movable between a closed position of the anti-return device in which the anti-return valve bears against the member forming a valve seat and an open position of the anti-return device in which the anti-return valve is moved away from the member forming a valve seat. With these arrangements it is possible to select the constitutive material of the valve seat, which may be very advantageous in the case of a specific application.

Preferably, the anti-return valve is an elastically deformable strip firmly secured to the member forming a valve seat.

According to another embodiment of the invention, the housing delimits a valve seat, and the anti-return device comprises an anti-return valve movable between a closed position of the anti-return device in which the anti-return valve bears against the valve seat and an open position of the anti-return device in which the anti-return valve is moved away from the valve seat.

Preferably, the compressor includes a partial obturation device mounted in the housing and arranged so as to partly obdurate the latter. The obturation device delimiting at least in part an orifice for letting through refrigerant fluid opening out into one of the compression chambers, the passage orifice being arranged so as to have said compression chamber communicate with the means for discharging and/or injecting refrigerant fluid when the anti-return device is in its open position. With these arrangements it is possible to easily obtain passage orifices having difficult or even impossible shapes to be made by machining the plate of the volutes. These arrangements also ensure great selection freedom as to the shape, the size and the positioning of the passage orifice.

Advantageously, the obturation device is mounted in the housing so that its surface turned towards the spirals are substantially aligned with the surface of the plate in which the housing is made.

Advantageously, the passage orifice is proportioned so that the spiral of the upper of the first and second volutes prevents communication between both compression chambers through the passage orifice during the orbital relative movement of both volutes. With these arrangements, it is possible to avoid leaks of fluid between two compression chambers and therefore a reduction in the performances of the compressor.

Preferentially, the passage orifice has a section of elongated shape and a width substantially less than or equal to the thickness of the spiral of the upper one of the first and second volutes. With these arrangements it is possible to increase the diverted amount of refrigerant fluid towards the means for discharging and/or injecting refrigerant fluid, and therefore to increase the yield of the compressor.

Advantageously, the passage orifice is partly delimited by the obturation device and partly by the wall of the housing. Alternatively, the passage orifice is entirely delimited by the obturation device.

According to an alternative embodiment, the passage orifice has a circular shape and the opening of the latter which opens out into the compression chamber is achieved by removing material from the surface of the insert turned towards the spirals and from the circumference of the passage orifice so that said opening has larger dimensions than those of the passage orifice.

Preferably, the member forming a valve seat is made with the obturation device out of the same material.

Advantageously, the compressor comprises means for controlling the anti-return device arranged so as to displace the latter between its closed and open positions.

Preferentially, the control means are arranged so as to connect the means for discharging refrigerant fluid, alternately with a high pressure fluid supply circuit and a low pressure fluid supply circuit, the anti-return device being displaced in its closed position when the means for discharging refrigerant fluid are connected with the high pressure fluid supply circuit, and in its open position when the means for discharging refrigerant fluid are connected with the low pressure fluid supply circuit.

According to another embodiment of the invention, the control means are arranged so as to connect the refrigerant fluid injection means with a refrigerant fluid injection circuit, the anti-return device being displaced into its open position when the refrigerant fluid injection means are connected with the refrigerant fluid injection circuit.

Advantageously, the means for discharging refrigerant fluid include a discharge conduit, one of the ends of which opens out into the housing and the other end of which opens out into a refrigerant gas suction space delimited by the compressor.

According to another embodiment of the invention, the means for discharging refrigerant fluid include a discharge conduit, one of the ends of which opens out into the housing and the other end of which opens out into a discharge opening made in the plate of one of the first and second volutes.

BRIEF DESCRIPTION OF THE DRAWINGS

In any way, the invention will be better understood with the following description, with reference to the appended schematic drawing illustrating as non-limiting examples, several embodiments of this scroll-type refrigerator compressor.

DETAILED DESCRIPTION OF THE EMBODIMENTS

In the following description, the same elements are designated by the same references in the different embodiments.

Figure 1:
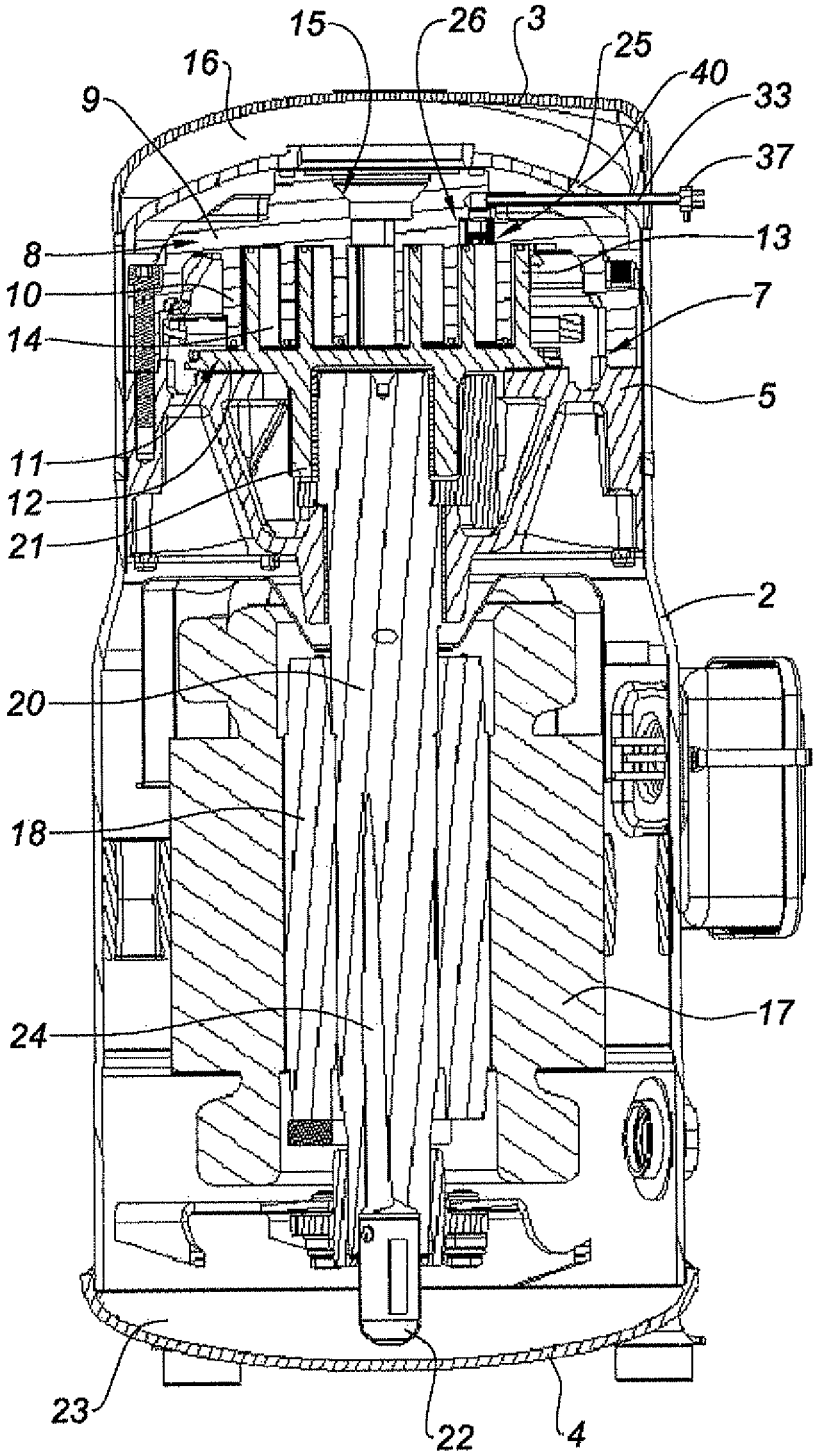
FIG. 1 is a longitudinal sectional view of a first compressor.

FIG. 1 describes a scroll-type refrigerator compressor with variable speed, occupying a vertical position. However, the compressor according to the invention may occupy a tilted position or a horizontal position, without its structure being significantly modified.

The compressor illustrated in FIG. 1 comprises a sealed enclosure delimited by a ferrule 2, the upper and lower ends of which are respectively closed by a lid 3, and a base 4. Assembling this enclosure may notably be achieved by means of welding beads.

The ferrule 2 comprises a refrigerant gas inlet (not shown in FIG. 1) opening out into a suction space for achieving inflow of refrigerant gas to the compressor.

The intermediate portion of the compressor is occupied by a body 5 used for mounting a stage 7 for compressing the refrigerant gas. This compressor stage 7 comprises a fixed volute 8 including a plate 9 from which extends a fixed spiral 10 turned downwards, and a mobile volute 11 including a plate 12 bearing against the body 5 and from which extends a spiral 13 turned upwards. Both spirals 10 and 13 of both volutes interpenetrate each other in order to form compression chambers 14 with a variable volume.

Admission of the gas into the compression stage is accomplished from the outside, the compression chambers 14 having a variable space which decreases from the outside to the inside, during the movement of the mobile volute 11 relatively to the fixed volute 8, the compressed gas escaping at the centre of the volute through a discharge opening 15 made in the fixed volute 8 towards a high pressure chamber 16 from which it is discharged through a fitting (not shown in the figure).

The compressor comprises a separation plate 40 covering the fixed volute 8 and sealably mounted on the latter. The separation plate 40 delimits two spaces, a low pressure suction space located below the latter, and a high pressure discharge space positioned above the latter.

The compressor comprises an electric motor positioned in the suction space, the electric motor comprises a stator 17 at the centre of which is positioned a rotor 18.

The rotor 18 is firmly secured to a drive shaft 20, the upper end of which is offset in the fashion of a crankshaft. This upper portion is engaged into a sleeve-shaped portion 21 which the mobile volute 11 includes. Upon its being driven into rotation by the motor, the drive shaft 20 drives the mobile volute 11 following an orbital movement.

The lower end of the drive shaft 20 drives an oil pump 22 supplying with oil contained in a case 23 delimited by the base 4, an oil supply conduit 24 made in the central portion of the drive shaft, the supply conduit 24 being offset and extends over a portion of the length of the drive shaft 20.

Figure 2:
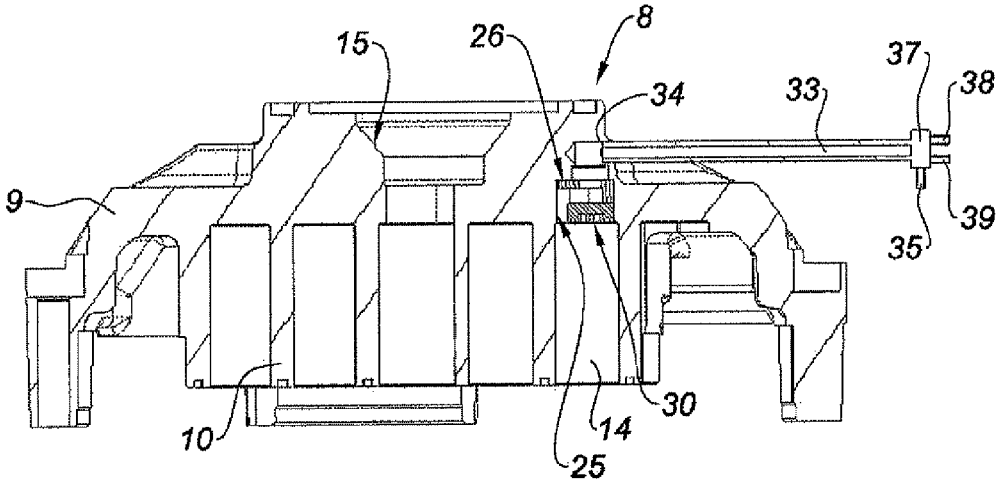
FIG. 2 is a longitudinal sectional view at an enlarged scale, of the fixed volute of the compressor of FIG. 1.
Figure 3:
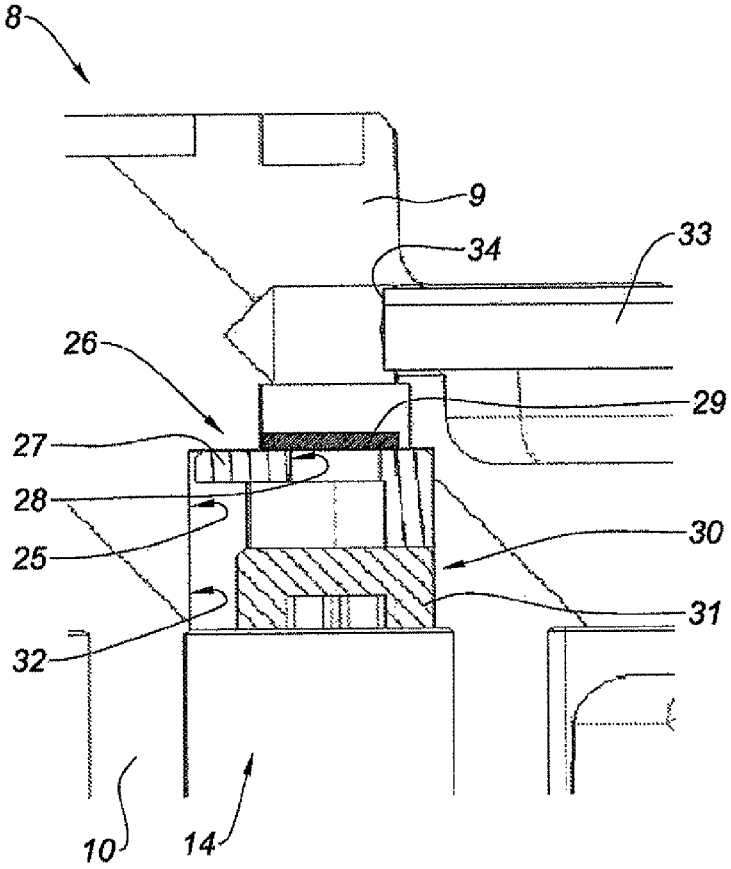
FIGS. 3 and 4 are partial longitudinal sectional views at an enlarged scale, of a detail of the fixed volute of the compressor of FIG. 1.
Figure 4:
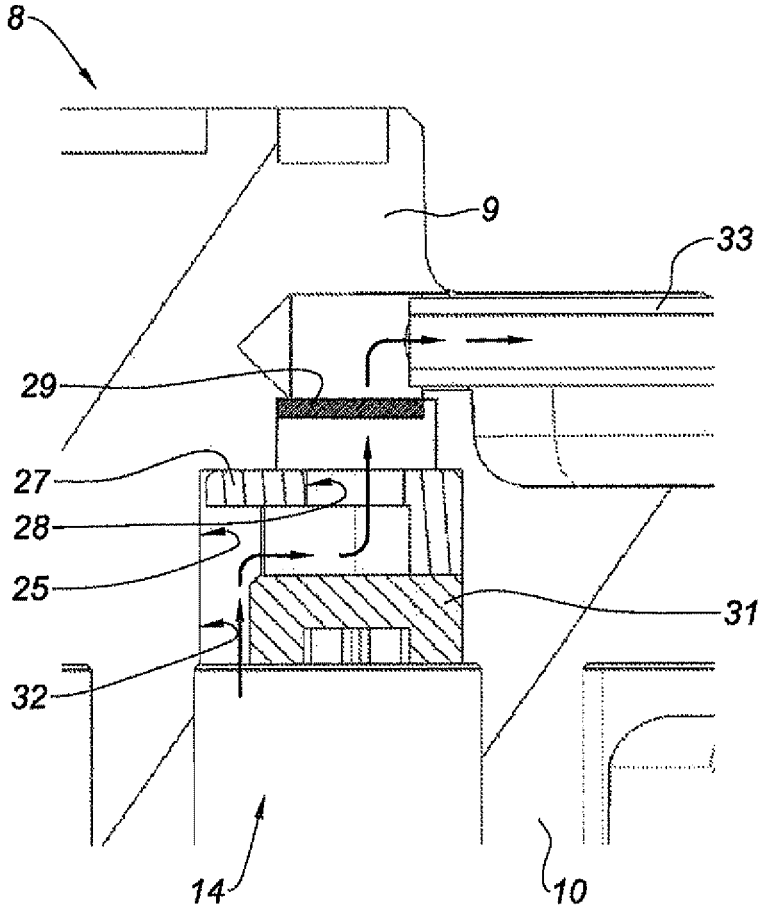

As shown more particularly in FIGS. 2 to 4, the compressor also comprises a substantially cylindrical housing 25 made in the lower surface of the plate 9 of the fixed volute 8, i.e. the surface of the plate 9 turned towards the spirals 10, 13. The housing 25 opens out into one of the compression chambers 14. The housing 25 has a maximum diameter substantially corresponding to the radial distance between two adjacent portions of the spiral 10 of the fixed volute 8.

The compressor further comprises an anti-return device 26 mounted in the housing 25. The anti-return device 26 comprises a member 27 forming a valve seat inserted into the housing 25 and delimiting a passage opening 28 on the one hand, and an anti-return valve 29 on the other hand, movable between a closed position (shown in FIG. 3) in which the anti-return valve 29 bears against the member forming a valve seat 27 and obturates the passage opening 28, an open position (shown in FIG. 4) in which the anti-return valve 29 is moved away from the member forming a valve seat 27 and clears the passage opening 28. The anti-return valve 29 has a substantially circular shape.

The compressor further comprises an obturation device 30 mounted in the housing 25 and arranged in order to obturate the latter. The obturation device 30 is also arranged so as to maintain the member forming a valve seat 27 in position, and more particularly for flattening the member forming a valve seat 27 against a bottom wall of the housing 25. Advantageously, the obturation device 30 comprises a substantially cylindrical obturation member 31 fixed in the housing 25. Preferably, the obturation member 31 is fixed in the housing 25 by adhesive bonding, screwing or force-fitting. The obturation member 31 is attached in the housing 25 so that its surface turned towards the spirals 10, 13 is flush with the lower surface of the plate 9 of the fixed volute 8.

The obturation member 31 partly delimits an orifice for letting through refrigerant gas 32 opening out into one of the compression chambers 14 and communicating with the passage opening 28 delimited by the member forming a valve seat 27.

Advantageously, the passage orifice 32 is proportioned so that the spiral 13 of the mobile volute 11 prevents connection of both compression chambers 14 through the passage orifice 32 during the orbital movement of the mobile volute 11.

Figure 5:
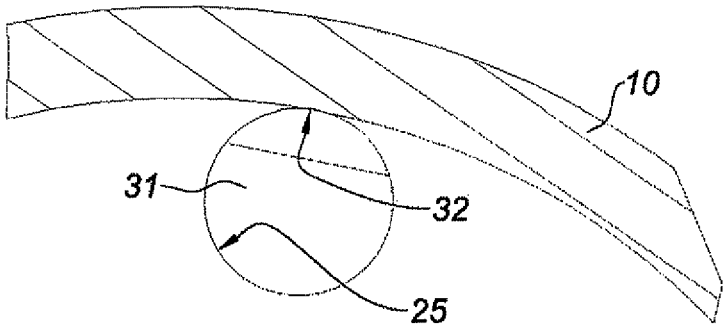
FIG. 5 is a view showing the passage orifice made in the plate of the fixed volute.
Figure 6:
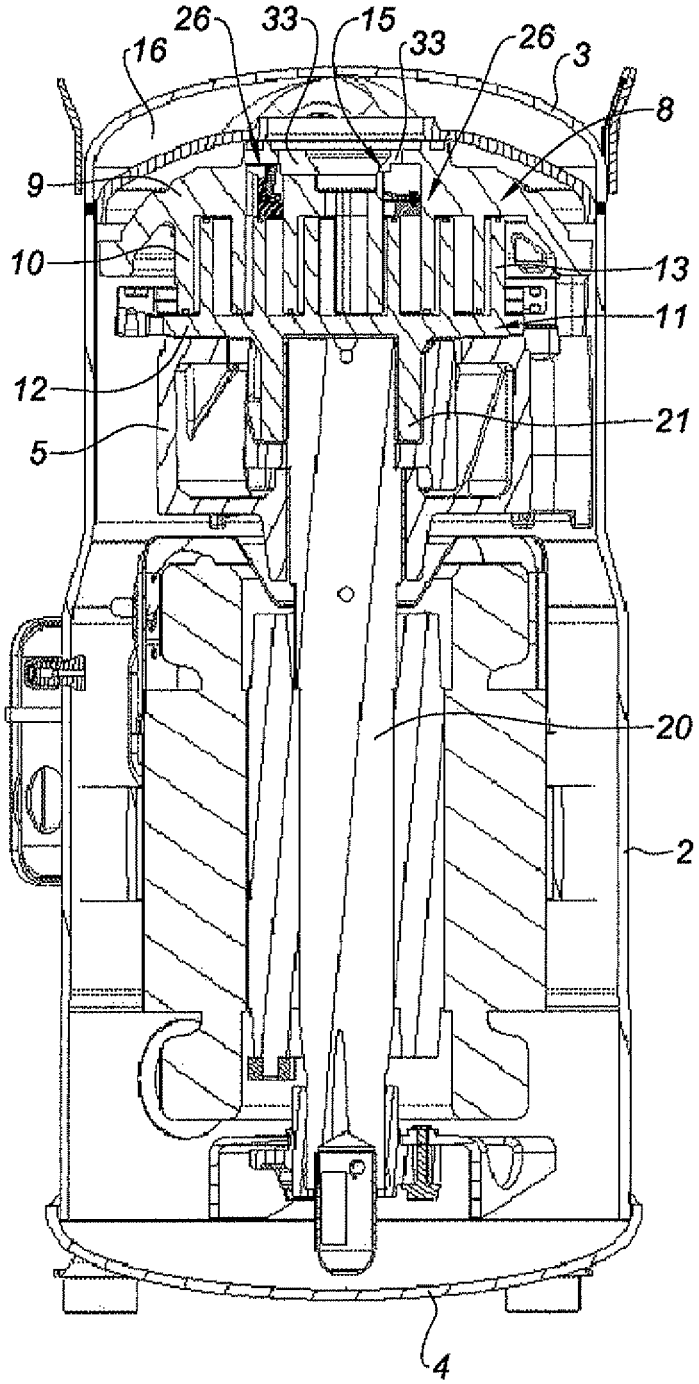
FIG. 6 is a longitudinal sectional view of a second compressor.
Figure 7:
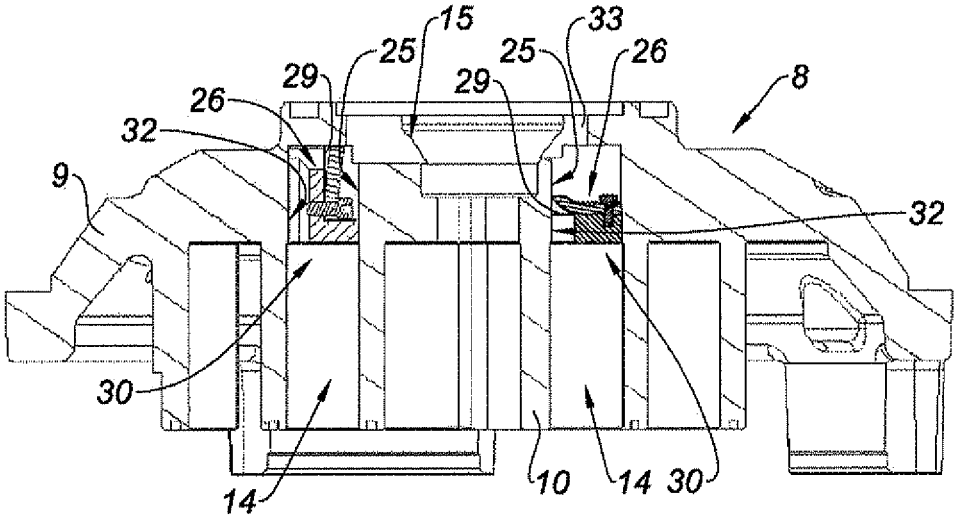
FIG. 7 is a longitudinal sectional view, at an enlarged scale, of the fixed volute of the compressor of FIG. 6.

As shown more particularly in FIG. 5, the passage orifice 32 has a section with an elongated shape and a width substantially less than or equal to the thickness of the spiral 13 of the mobile volute 11. Preferentially, the passage orifice 32 is delimited partly by the obturation member 31 and partly by the wall of the housing 25. Consequently, the passage orifice 32 substantially opens out along the wall of the spiral 10 of the fixed volute 8.

According to an alternative embodiment, the passage orifice 32 may be entirely delimited by the obturation member 31.

The compressor comprises a refrigerant gas discharge conduit 33 comprising a first end 34 opening out into the housing 25 downstream from the anti-return valve 29 relatively to the member forming a valve seat 27, and a second end 35 opening out into the suction space delimited by the ferrule 2.

As shown in FIG. 4, during the orbital movement of the mobile volute 11 and when the anti-return valve 29 is in its open position, part of the compressed refrigerant gas in the compression chamber 14 into which opens out the passage orifice 32, is discharged into the suction space while successively flowing through the passage orifice 32, the passage opening 28 delimited by the member forming a valve seat 27, and the discharge conduit 33.

With these arrangements, it is possible to reduce the amount of compressed refrigerant gas during the compressor operating cycle, and therefore to reduce the capacity of the latter.

Of course, such a reduction in the capacity of the compressor is not continually desired.

Thus, the compressor comprises means 37 for controlling the anti-return device arranged for displacing the anti-return valve 29 between its closed and open positions depending on whether it is desired to use the maximum capacity of the compressor or not.

The control means are arranged so as to alternately connect the discharge conduit 33 to a high pressure fluid supply circuit 38 and to a low pressure fluid supply circuit 39.

When it is desired to use the maximum capacity of the compressor, the control means connect the discharge conduit 33 to the high pressure fluid supply circuit 38. Thus, the anti-return valve 29 is subject, on its face opposite to the member forming a valve seat 27, to the pressure of a high pressure fluid so that the anti-return valve 29 is held flattened onto the member forming a valve seat 27 and it isolates the compression chamber 14 into which opens out the passage orifice 32, from the suction space.

When it is desired to reduce the useful capacity of the compressor, the control means connect the discharge conduit 33 to the low pressure fluid supply circuit 39. Thus, the anti-return valve 29 is subject, on its face opposite to the member forming a valve seat 27, to the pressure of a low pressure fluid so that the anti-return valve 29 is lifted and connects the compression chamber 14 into which opens out the passage orifice 32, with the suction volume. In order to promote the displacement of the anti-return valve 29 towards its open or closed position, a spring acting in an opening or closing direction of the valve may be associated with the latter.

According to an alternative embodiment, the control means may be arranged in order to alternately connect the discharge conduit 33 to a high pressure fluid supply circuit 38 and to the suction space delimited by the ferrule of the compressor.

FIGS. 6 to 9 illustrate a second embodiment of the invention.

According to this embodiment, the compressor comprises two substantially cylindrical housings 25 made in the lower surface of the plate 9 of the fixed volute 8. The compressor further comprises an anti-return device 26 and an obturation device 30 mounted in each housing 25.

According to this embodiment, the member forming a valve seat 27 of each anti-return device 26 is made together with the obturation member 31 of the corresponding obturation device 30, in the same material.

Further, according to this embodiment, the anti-return valve 29 of each anti-return device 26 consists of a strip firmly secured to the corresponding member forming a valve seat 27 and elastically deformable between a closed position (shown in FIG. 8) in which the valve 29 bears against the corresponding member forming a valve seat 27 and obturates the passage opening 28 delimited by the latter and an open position (shown in FIG. 9) in which the valve bears against a retaining plate 45 firmly secured to the corresponding member forming a valve seat 27 and clears the passage opening 28 delimited by the latter. Advantageously, the abutment plate 45 of each anti-return device 26 is attached by screwing onto the corresponding member forming a valve seat 27.

Thus, each anti-return device 26 and each corresponding obturation device 30 form a cartridge unit, which facilitates the mounting of the anti-return and obturation devices in the respective housings.

According to this embodiment, the compressor comprises two refrigerant gas discharge conduits, each discharge conduit 33 including a first end opening out into one of the housings 25 and a second end opening out into the discharge opening 15 made in the fixed volute 8.

Advantageously, the compressor does not include any means for controlling the anti-return valve 29 of each anti-return device 26.

In this case, each anti-return valve 29 is arranged so as to deform only towards its open position when the compression in the compression chamber 14 into which opens the corresponding passage orifice 32, is greater than the pressure in the discharge orifice 15.

Figure 8:
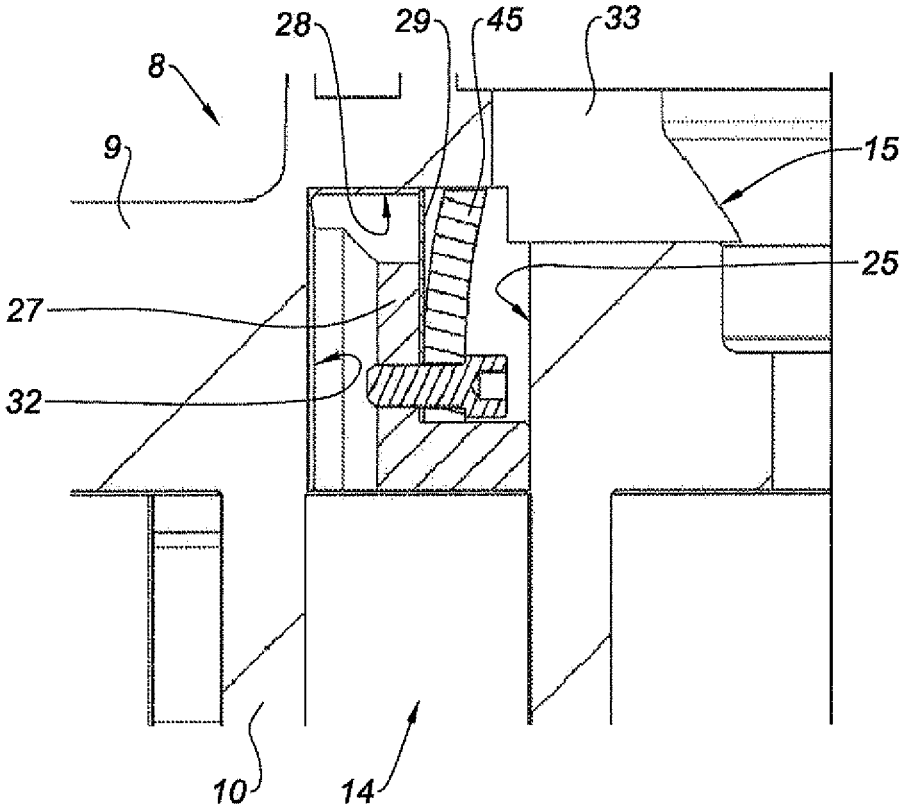
FIGS. 8 and 9 are partial longitudinal sectional views at an enlarged scale, of a detail of the fixed volute of the compressor of FIG. 6.

Thus, when the anti-return valve 29 of each anti-return device 26 is subject, on its face turned towards the member forming a valve seat, to a pressure of less than the pressure in the discharge orifice 15, the valve 29 is maintained flattened on the member forming a valve seat (as this is shown in FIG. 8) and isolates the compression chamber 14 into which opens out the corresponding passage orifice 32 of the discharge orifice 15 made in the fixed volute 8. The result of this is that the compression level of the compressor is maintained at its maximum value.

Figure 9:
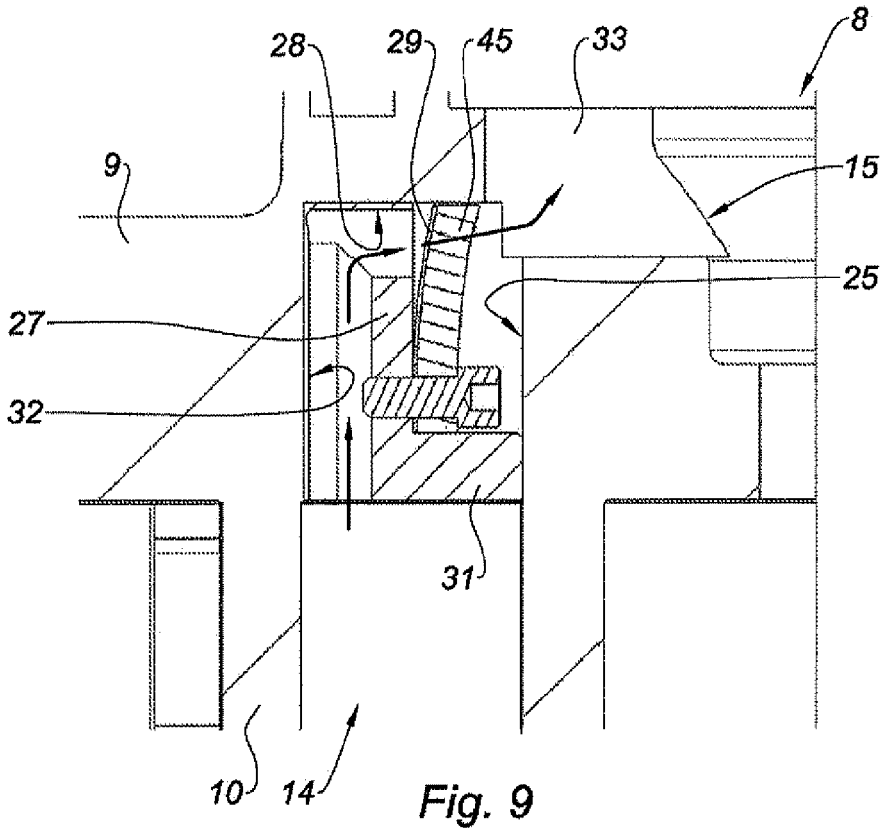

When the anti-return valve 29 of each anti-return valve 26 is subject, on its face turned towards the member forming a valve seat, to a greater pressure than the pressure in the discharge orifice 15, the valve 29 elastically deforms towards its open position (as this is shown in FIG. 9) and connects the compression chamber 14 into which opens out the corresponding passage orifice 32, with the discharge orifice 15 made in the fixed volute 8. Thus the result of this is backflow towards the discharge orifice 15 of a portion of the compressed refrigerant gas in the compression chambers 14 into which the passage orifices 32 open out, before this portion of the refrigerant gas reaches the center of the spirals 10, 13.

With these arrangements, it is possible to reduce the compression level of each compression chamber and therefore of the compressor, and consequently improve the yield of the compressor.

With this arrangement, it is also possible to avoid obtaining too high pressures in the compression volume.

According to an alternative embodiment, each discharge conduit 33 may include a first end opening out into one of the housings 25 and a second end opening out into the high pressure chamber 16.

According to an alternative embodiment, the compressor may only include a single cartridge or two identical cartridges.

Figure 10:
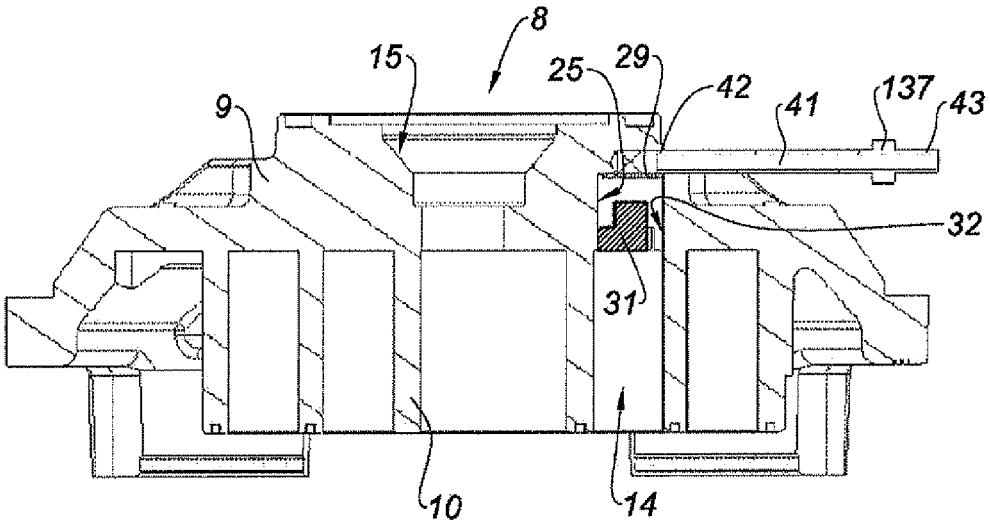
FIG. 10 is a longitudinal sectional view, at an enlarged scale, of the fixed volute of a third compressor.
Figure 11:
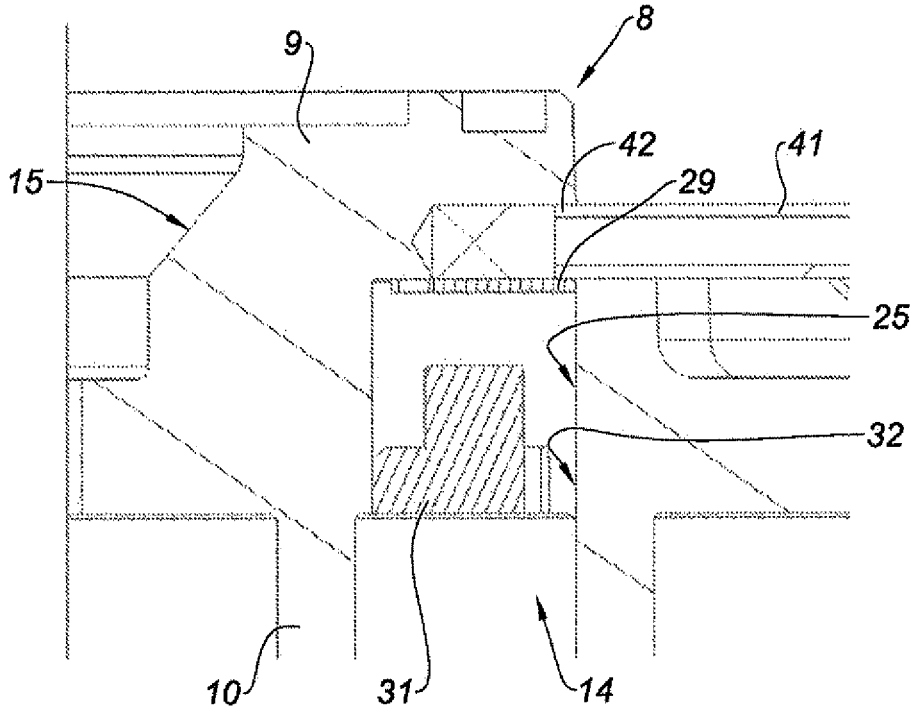
FIGS. 11 and 12 are partial longitudinal sectional views, at an enlarged scale, of a detail of the fixed volute of the compressor of FIG. 10.
Figure 12:
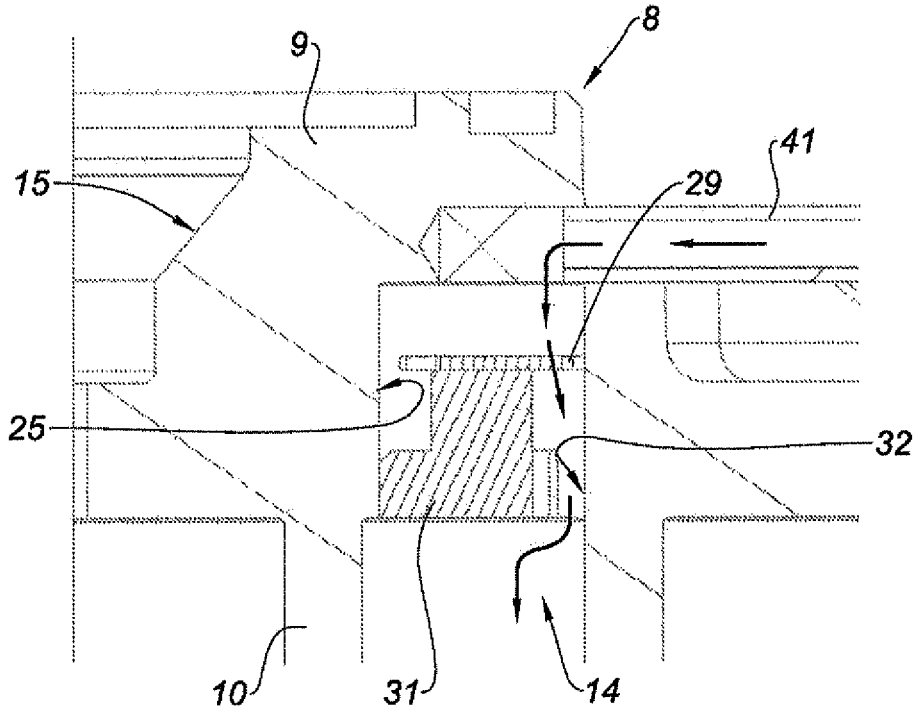

FIGS. 10 to 12 illustrate a third embodiment of the invention which differs from the first embodiment essentially in that the valve seat is delimited by the housing 25, and in that the compressor comprises a refrigerant gas injection conduit 41 comprising a first end 42 opening out into the housing 25 downstream from the anti-return valve 29 relatively to the obturation member 31, and a second end 43 connected to a circuit for injecting refrigerant gas (not shown in the figure).

According to this embodiment, the control means 137 of the anti-return device are arranged in order to connect the injection conduit 41 with the circuit for injecting refrigerant gas on the one hand, and for isolating the injection conduit 41 from the circuit for injecting refrigerant gas, on the other hand.

When it is desired to use the useful capacity of the compressor, the control means 137 isolate the injection conduit 41 with respect to the refrigerant gas injection circuit. Thus, the anti-return valve 29 is subject, on its face turned towards the obturation member 31, to the pressure of the compressed refrigerant gas in the compression chamber 14 into which the passage orifice 32 opens out so that the anti-return valve 29 is maintained flattened on its valve seat and isolates said compression chamber 14 from the injection conduit 41. In order to promote this flattening of the anti-return valve against its seat, a spring acting in a direction for closing the valve may be inserted between the latter and the obturation member 31.

When it is desired to increase the useful capacity of the compressor, the control means 137 connect the injection conduit 41 to the refrigerant gas injection circuit. Thus, the anti-return valve 29 is subject, on its face opposite to the obturation member 31, to the pressure of a high pressure fluid so that the anti-return valve 29 will be flattened against the obturation member 31 and connects the compression chamber 14 into which the passage orifice 32 opens out, with the injection conduit 41, which allows injection of refrigerant gas into said compression chamber 14.

With these arrangements it is possible to increase the amount of compressed refrigerant gas in the compression chambers during the operating cycle of the compressor, and therefore increase the capacity of the latter.

As this is obvious, the invention is not limited to the sole embodiment of this scroll-type refrigerator compressor, described above as examples, on the contrary it encompasses all the alternative embodiments thereof.

The invention claimed is:

1. A scroll-type refrigerator compressor comprising first and second volutes describing an orbital relative movement, the first volute including a first plate from which a first spiral extends, and the second volute including a second plate from which a second spiral extends, the first and the second spirals being engaged one inside the other and delimiting at least two compression chambers of variable volume, wherein the compressor includes:

at least one housing made in the first plate and extending from a surface of the first plate that is turned towards the first and the second spirals, the housing opening out into one of the compression chambers, means for injecting refrigerant fluid, opening out into the housing, an anti-return device mounted in the housing, the housing including an introduction aperture that introduces the anti-return device into the housing, the introduction aperture being turned towards the first and the second spirals and opening out into one of the compression chambers, the anti-return device being arranged so as to prevent communication between the means for injecting refrigerant fluid and the compression chamber into which the introduction aperture of the housing opens out in a first closed position, and being arranged so as to allow communication between the refrigerant fluid injection means and the compression chamber into which the introduction aperture of the housing opens out in a second open position, and a partial obturation device mounted in the housing and arranged in order to partly obturate the housing, the obturation device delimiting at least partly a passage orifice for letting through refrigerant fluid, opening out into one of the compression chambers, the passage orifice being arranged so as to connect said compression chamber with the refrigerant fluid injection means when the anti-return device is in its open position, wherein the introduction aperture is located on a side of the obturation device.

2. The compressor according to claim 1, wherein the anti-return device comprises a valve seat member and an anti-return valve movable between a closed position of the anti-return device in which the anti-return valve bears against the valve seat member and an open position of the anti-return device in which the anti-return valve is moved away from the valve seat member.

3. The compressor according to claim 2, wherein the anti-return valve is an elastically deformable strip firmly secured to the valve seat member.

4. The compressor according to claim 1, wherein the housing delimits a valve seat, and the anti-return device comprises an anti-return valve mobile between a closed position of the anti-return device in which the anti-return valve bears against the valve seat and an open position of the anti-return device in which the anti-return valve is moved away from the valve seat.

5. The compressor according to claim 1, wherein the passage orifice is proportioned so that the second spiral prevents communication between two compression chambers through the passage orifice during the orbital relative movement of the first and the second volutes.

6. The compressor according to claim 1, wherein the passage orifice has a section with an elongated shape and a width less than or equal to a thickness of the second spiral.

7. The compressor according to claim 1, wherein the passage orifice is delimited partly by the obturation device and partly by a wall of the housing.

8. The compressor according to claim 1, wherein the valve seat member is made together with the obturation device in the same material.

9. The compressor according to claim 1, wherein the compressor comprises means for controlling the anti-return device arranged in order to displace the anti-return device between its closed and open positions.

10. The compressor according to claim 9, wherein the control means are arranged in order to connect the refrigerant fluid injection means with a refrigerant fluid injection circuit, the anti-return device being displaced in its open position when the refrigerant fluid injection means are connected with the refrigerant fluid injection circuit.

11. A scroll-type refrigerator compressor comprising first and second volutes describing an orbital relative movement, the first volute including a first plate from which a first spiral extends, and the second volute including a second plate from which a second spiral extends, the first and the second spirals being engaged one inside the other and delimiting at least two compression chambers of variable volume, wherein the compressor includes:

at least one housing made in the first plate and extending from a surface of the first plate that is turned towards the first and the second spirals, the housing opening out into one of the compression chambers, means for discharging refrigerant fluid, opening out into the housing, an anti-return device mounted in the housing, the housing including an introduction aperture that introduces the anti-return device into the housing, the introduction aperture turned towards the first and the second spirals and opening out into one of the compression chambers, the anti-return device being arranged so as to prevent communication between the means for discharging refrigerant fluid and the compression chamber into which the introduction aperture of the housing opens out in a first closed position, and being arranged so as to allow communication between the refrigerant fluid discharge means and the compression chamber into which the introduction aperture of the housing opens out in a second open position, and a partial obturation device mounted in the housing and arranged in order to partly obturate the housing, the obturation device delimiting at least partly a passage orifice for letting through refrigerant fluid, opening out into one of the compression chambers, the passage orifice being arranged so as to connect said compression chamber with the refrigerant fluid discharge means when the anti-return device is in its open position, wherein the introduction aperture is located on a side of the obturation device.

12. The compressor according to claim 11, wherein the refrigerant fluid discharge means include a discharge conduit having a first end and a second end, the first end of the discharge conduit opens out into the housing and the second end of the discharge conduit opens out into a refrigerant gas suction space delimited by the compressor.

13. The compressor according to claim 11, wherein the refrigerant fluid discharge means include a discharge conduit having a first end and a second end, the first end of the discharge conduit opens out into the housing and the second end of the discharge conduit opens out into a discharge opening made in the first plate.

14. The compressor according to claim 11, wherein the compressor comprises means for controlling the anti-return device arranged in order to displace the anti-return device between its closed and open positions.

15. The compressor according to claim 14, wherein the control means are arranged for alternately connecting the refrigerant fluid discharge means with a high pressure fluid supply circuit and a low pressure fluid supply circuit, the anti-return device being displaced in its closed position when the refrigerant fluid discharge means are connected with the high pressure fluid supply circuit, and in its open position when the refrigerant fluid discharge means are connected with the low pressure fluid supply circuit.

* * * * *